US008991968B2

(12) United States Patent
Raming

(10) Patent No.: US 8,991,968 B2
(45) Date of Patent: Mar. 31, 2015

(54) DUPLEX PRINTER WITH MOVABLE PRINT HEAD

(71) Applicant: Premier Print & Services Group, Inc., Chicago, IL (US)

(72) Inventor: Bruce Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 0 days.

(21) Appl. No.: 14/509,869

(22) Filed: Oct. 8, 2014

(65) Prior Publication Data

US 2015/0022607 A1 Jan. 22, 2015

Related U.S. Application Data

(63) Continuation of application No. 13/834,005, filed on Mar. 15, 2013, now Pat. No. 8,857,943.

(51) Int. Cl.
*B41J 29/38* (2006.01)
*B41J 3/407* (2006.01)
*B41J 11/42* (2006.01)

(52) U.S. Cl.
CPC ..... *B41J 3/4075* (2013.01); *B41J 11/42* (2013.01)
USPC ..... 347/16; 347/101; 347/105; 347/107

(58) Field of Classification Search
CPC ..... B41J 3/4075; B41J 3/42; B41J 3/60; B41J 3/543; B41J 3/546; B41J 15/18; B41J 15/20; B41J 15/22; B41J 15/24
USPC ..... 347/8, 16, 37, 101, 104–107, 218–220; 400/55, 58, 59, 149, 188
See application file for complete search history.

(56) References Cited

U.S. PATENT DOCUMENTS 7,891,893 B2 * 2/2011 Sekino et al. ..... 400/188
8,109,537 B2 * 2/2012 Raming ..... 283/81

* cited by examiner

*Primary Examiner* — Juanita D Jackson
(74) *Attorney, Agent, or Firm* — Hovey Williams LLP

(57) ABSTRACT

A duplex printer system includes a double-sided label web and a duplex printer operable to print both sides of the label web. The label includes exposed adhesive on a first side thereof. The duplex printer includes a printer frame and first and second print heads arranged to print respective sides of the label web. The first print head is shiftably mounted relative to the printer frame for movement into and out of a printing position, in which the first print head is operable to print within a printable region of the first side. The first print head is selectively shifted out of the printing position so as to avoid contact with exposed adhesive during label web advancement. The first print head includes a printer interface positioned in printing engagement with the label web when the first print head is shifted to the printing position. The printer interface is spaced from a first adhesive side area and is thereby prevented from engaging the exposed adhesive applied thereto when the first print head is shifted to the printing position.

19 Claims, 7 Drawing Sheets

DUPLEX PRINTER WITH MOVABLE PRINT HEAD

RELATED APPLICATION

This is a continuation of prior application Ser. No. 13/834,005, filed Mar. 15, 2013, now issued as U.S. Pat. No. 8,857,943 B2, entitled DUPLEX PRINTER WITH MOVABLE PRINT HEAD, which is hereby incorporated in its entirety by reference herein.

BACKGROUND

1. Field

The present invention relates generally to printing of business forms. More specifically, embodiments of the present invention concern a duplex printer with a movable print head to print labels with exposed adhesive.

2. Discussion of Prior Art

Duplex printing systems are known in the art for printing opposite sides of a business form. Conventional systems include a pair of print heads located on opposite sides of the form. The print heads print both sides of the form as the form is advanced through the printer. It is also known to have a printer with printing ribbon and a print head that are disengaged during printing to save printer ribbon. In particular, the printing ribbon and print head are disengaged from the label web as an unprinted portion of the web is moved past the head. The print head is disengaged by shifting the print head away from the business form. With the print head removed from the web, the ribbon is also disengaged and thereby no longer advanced by the web.

However, conventional duplex printing systems suffer from various deficiencies. For instance, such conventional systems are unable to effectively print both sides of a linerless label construction. Specifically, because of the absence of a removable liner ply, linerless labels have an exposed layer of adhesive. Linerless labels with exposed adhesive cause various problems when advanced through prior art printers. For instance, the adhesive can restrict label advancement through the printer. Also, components of the printer, such as the print head, can be partly or entirely disabled by collecting adhesive from the label.

SUMMARY

The following brief summary is provided to indicate the nature of the subject matter disclosed herein. While certain aspects of the present invention are described below, the summary is not intended to limit the scope of the present invention.

Embodiments of the present invention provide a duplex printer system that does not suffer from the problems and limitations of the prior art printing systems set forth above.

A first aspect of the present invention concerns a duplex printer system that broadly includes a double-sided label web and a duplex printer. The double-sided label web is operable to be printed on opposite first and second sides thereof. The first side of the label web presents longitudinally spaced apart printable regions devoid of adhesive. The first side of the label web includes exposed adhesive located at least in part between printable regions. The label web presents longitudinally extending sides between which the label width is defined. Each of the printable regions is spaced from a first one of the label sides to define a corresponding first side margin. The label web includes exposed adhesive applied to a first adhesive side area located within the first side margin.

The duplex printer is operable to print both sides of the label web as the label web is advanced longitudinally through the printer. The duplex printer broadly includes a printer frame, and first and second print heads. The printer frame presents a web path along which the label web passes longitudinally through the printer in a feed direction. The first and second print heads are supported relative to the printer frame and are arranged to print respective sides of the label web as the label web makes a single pass along the web path. The first print head is shiftably mounted relative to the printer frame for movement into and out of a printing position, in which the first print head is operable to print within a respective one of the printable regions. The first print head is selectively shifted out of the printing position so as to avoid contact with the exposed adhesive during label web advancement. The first print head includes a printer interface positioned in printing engagement with the label web when the first print head is shifted to the printing position. The printer interface is spaced from the first adhesive side area and is thereby prevented from engaging the exposed adhesive applied thereto when the first print head is shifted to the printing position.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a top perspective view of a print and apply station constructed in accordance with a preferred embodiment of the present invention, including a duplex printer, a label cutting mechanism, and a label applicator, and showing the duplex printer printing a web of linerless duplex labels from a label roll, cutting the printed labels to detach an end-most label from the label roll, and applying the detached linerless label to a package;

Figure 1:
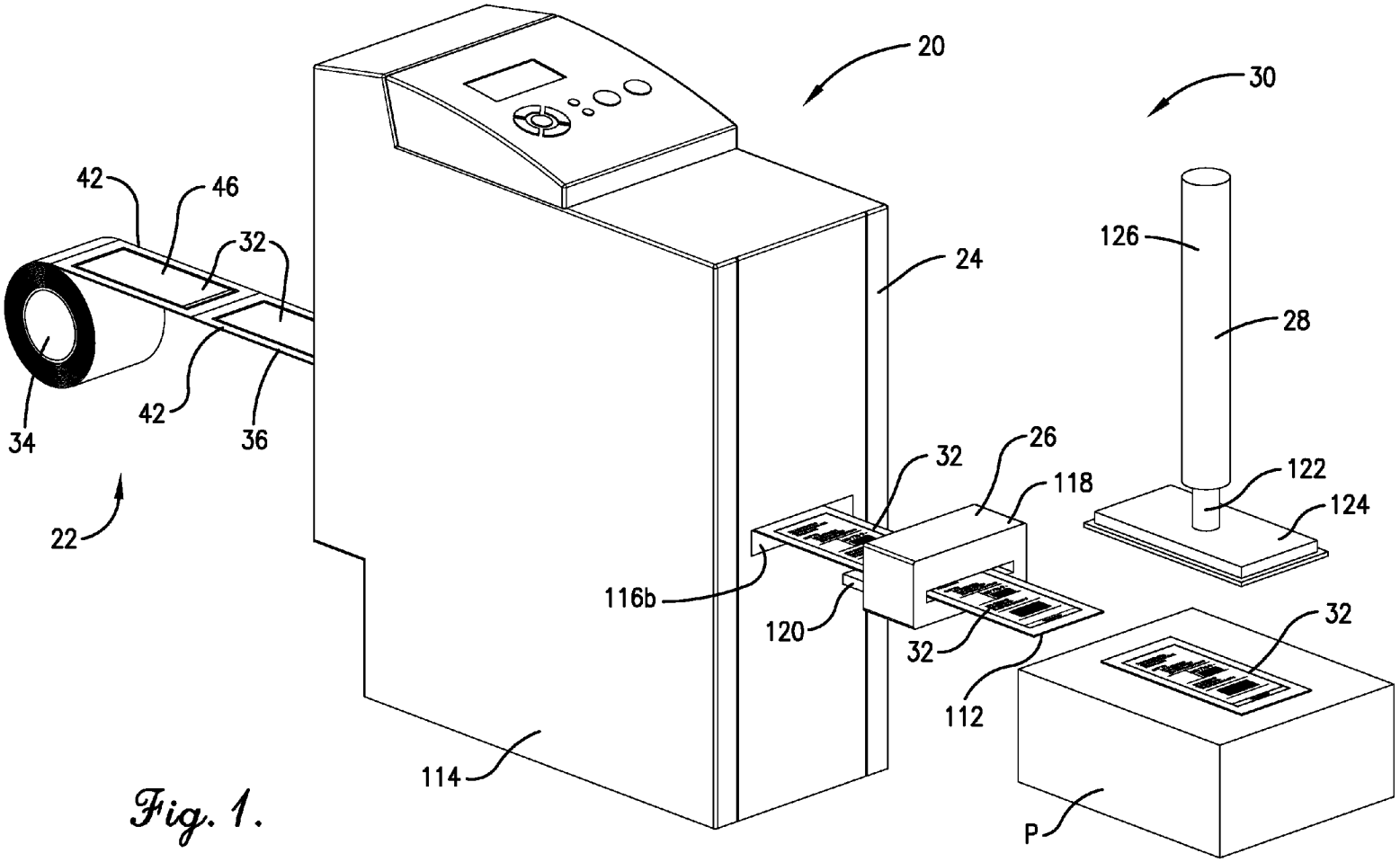
Figure 4:
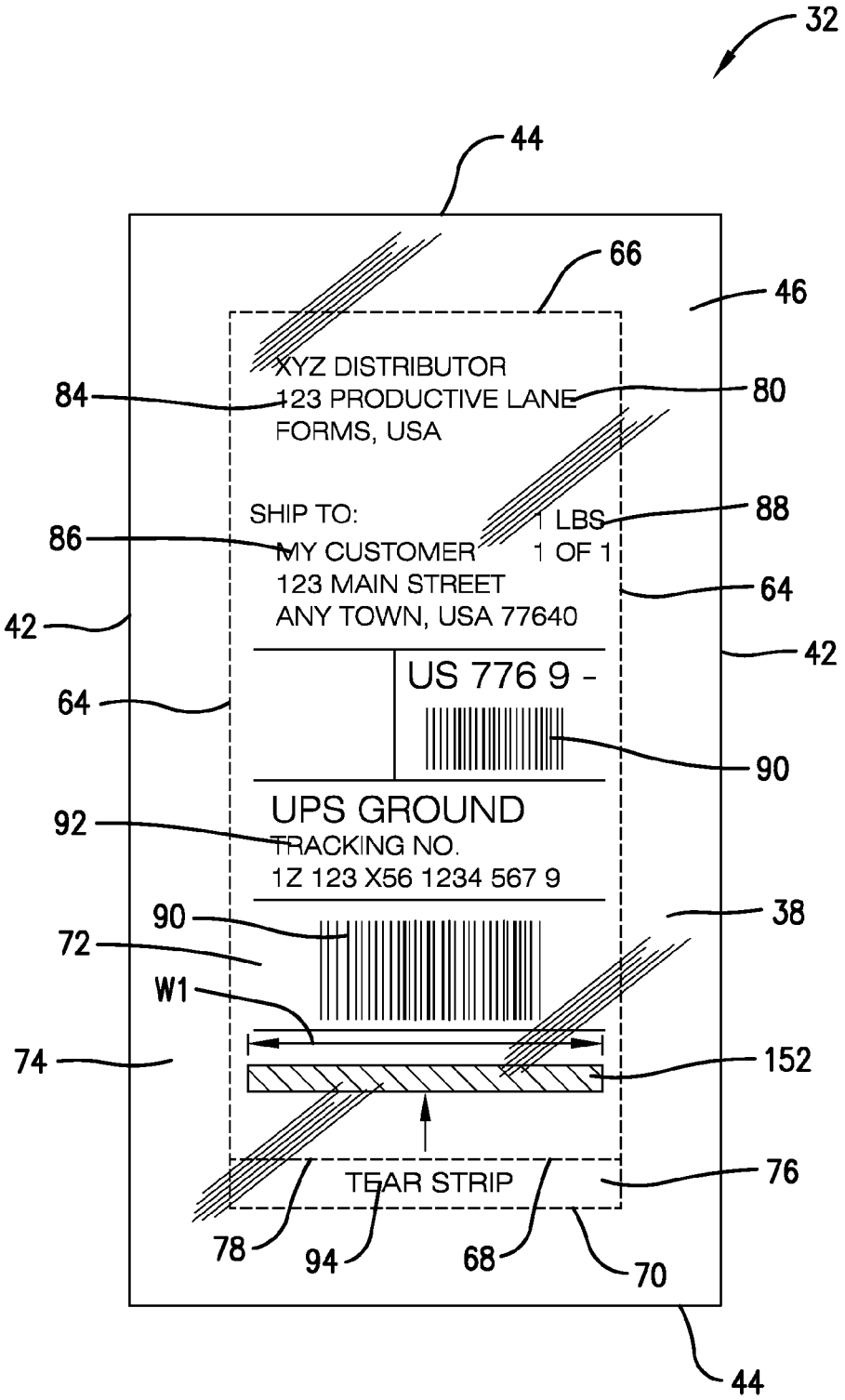
Figure 5:
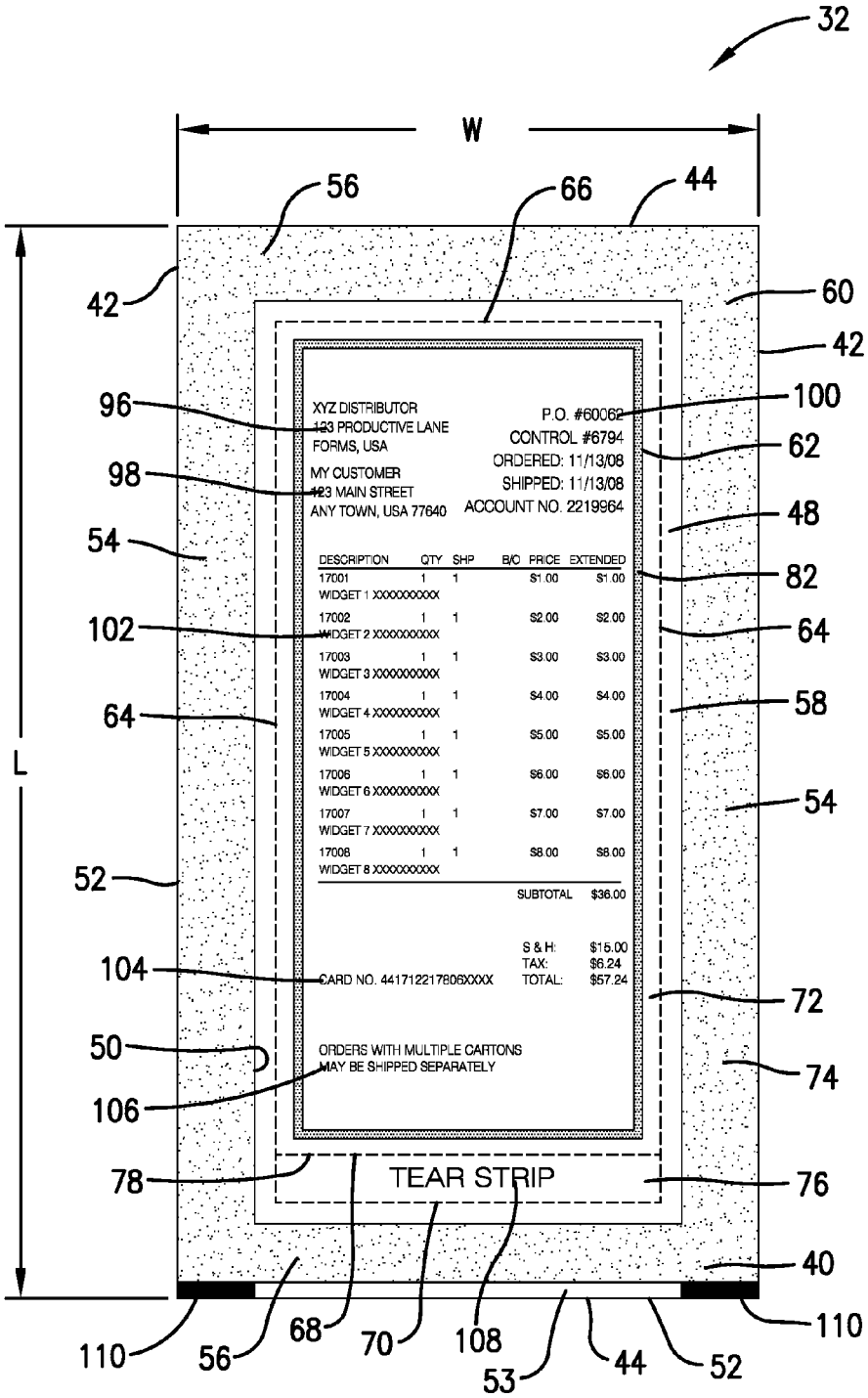
Figure 6:
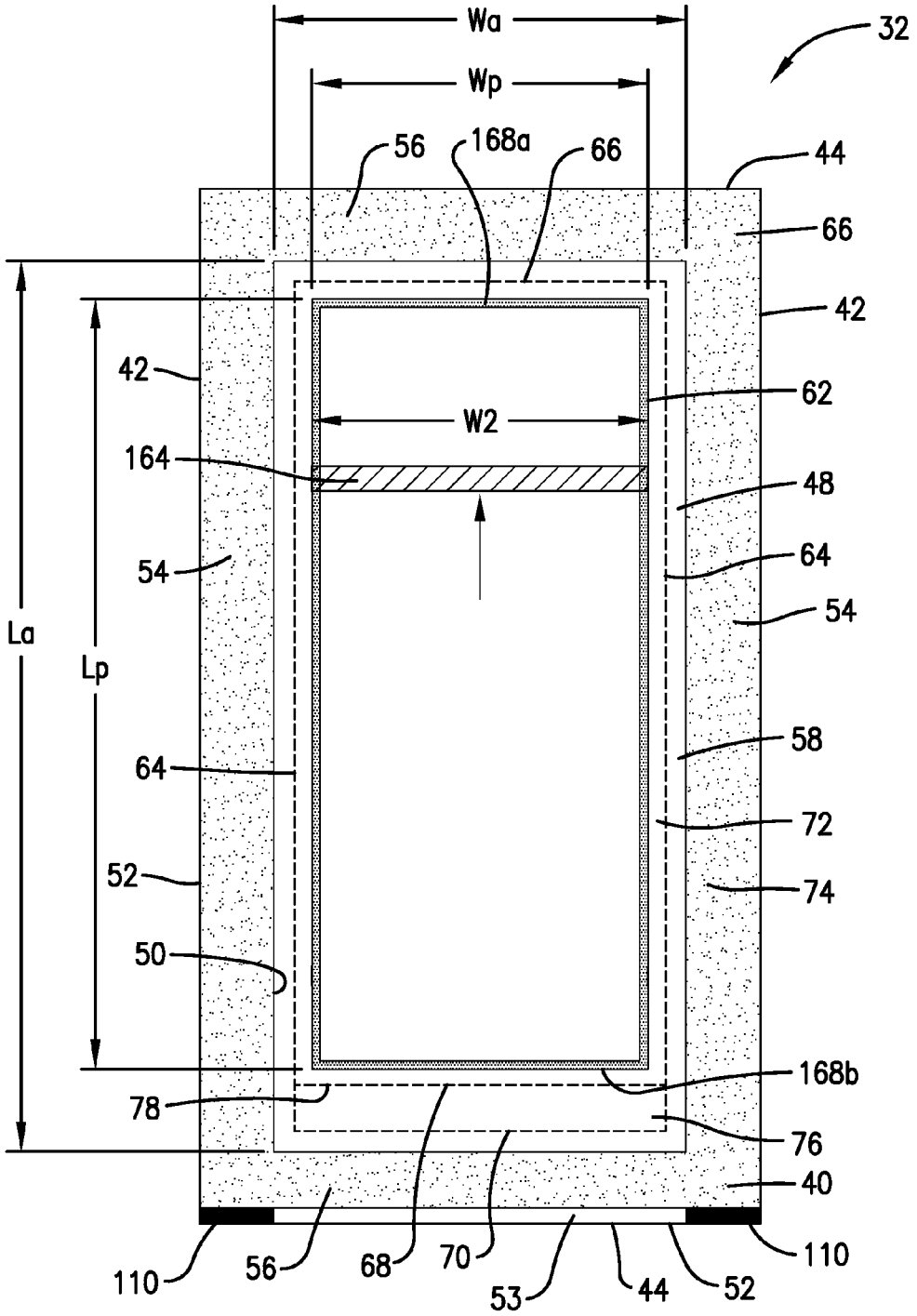
Figure 7:
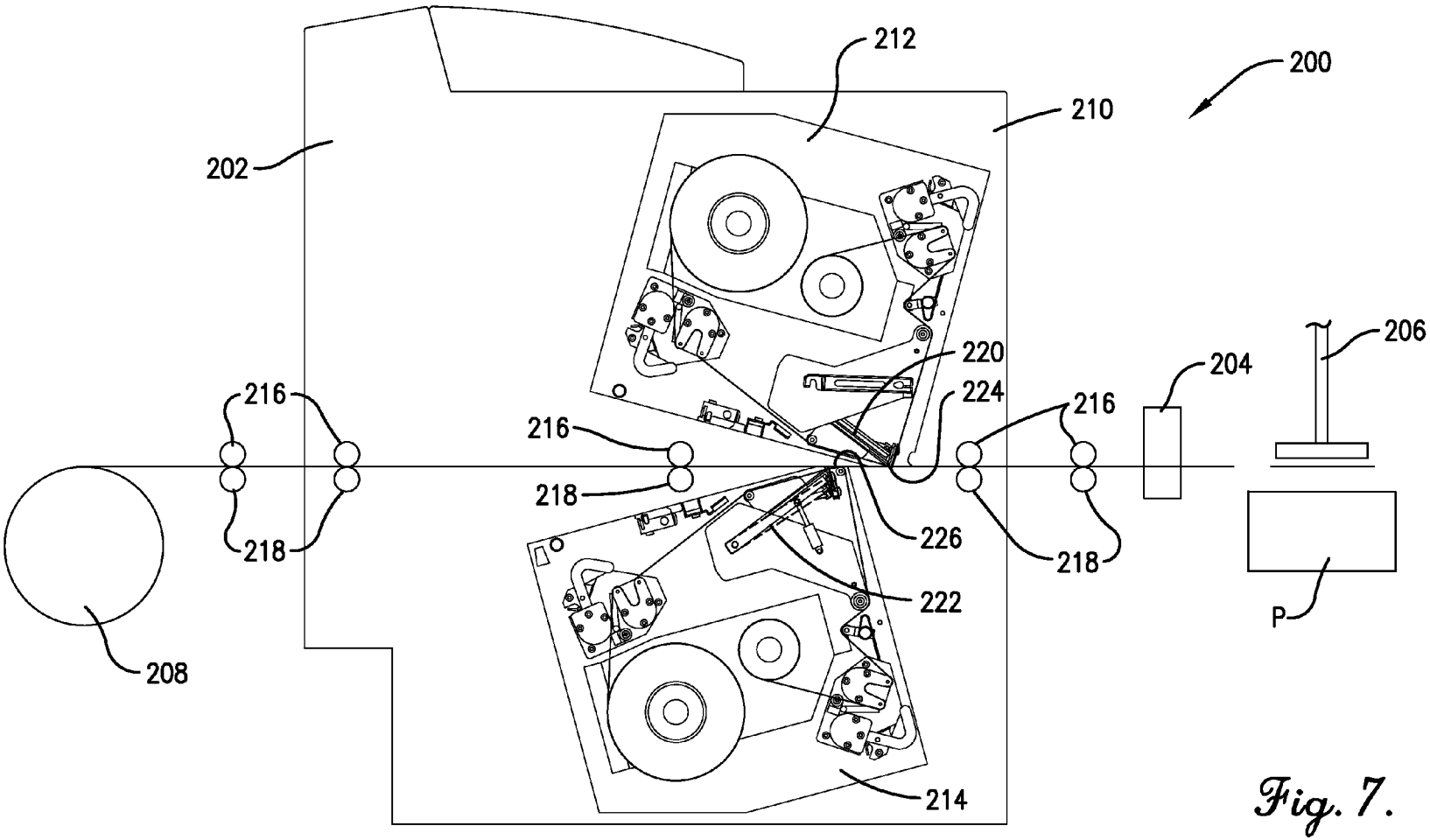

FIG. 4 is a top elevation of one of the preferred printed labels shown in FIG. 1, showing a single-ply label stock of the linerless duplex label with an endless border portion and a central portion, with perforation lines extending between the border and central portions and defining a tear strip removably connecting the portions, and a transparent release coating applied to a top face of the label stock, with exposed indicia printed on the top face;

FIG. 5 is a bottom elevation of the printed label shown in FIGS. 1 and 4, showing an adhesive layer of the label applied to a bottom face of the label stock, with the adhesive layer being applied to define an endless border region of the label stock and an adhesive-free region of the label stock, with the label also presenting a printable region within the adhesive-free region that receives hidden indicia;

FIG. 6 is a bottom elevation of the printed label similar to FIG. 5, but with the hidden indicia being removed and showing the location of the printing interface as the web is moved past the shiftable print head; and FIG. 7 is a schematic view of a print and apply station constructed in accordance with a second embodiment of the present invention, with the station including an alternative duplex printer, label cutter, applicator, and label supply, and showing upper and lower print engines of the duplex printer.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Turning initially to FIG. 1, a duplex printer system 20 is constructed in accordance with a preferred embodiment of the present invention. The printer system 20 is configured particularly suitable for use in printing linerless combination shipping and packing list labels for adhesive application on a package P. However, as will be explained, the printer may alternatively be used to print other types of labels (such as labels having a liner, labels for other uses, etc.) as long as such labels have an exposed adhesive on at least one side thereof. The duplex printer system 20 broadly includes an overlaid label supply 22 and a duplex printer 24. The duplex printer 24 is configured to print the label in a single printing pass, as will be discussed. Also, the duplex printer system 20 is preferably paired with a label cutter 26 and a label applicator 28 as part of a duplex print and apply station 30. The illustrated station 30 can print a duplex packing and shipping label and apply the printed label to package P. However, for some aspects of the present invention, the printer system 20 could be employed with alternative label applicator equipment or could be used in connection with a manual label application process. Also, while the illustrated station 30 is preferably used to print and apply combination shipping and packing slip labels, the principles of the present invention are applicable where the station 30 is used to print and apply an alternative business form. For instance, the station 30 could be used to print a label associated with shipping the package P as a gift.

Turning to FIGS. 1 and 4-6, the overlaid linerless label supply 22 is preferably in the form of a continuous roll, which provides a plurality of duplex labels for printing and application onto a substrate as a shipping and packing label. Although the label supply may be pre-printed with various static indicia, the real benefit of the printer system 20 is when it is used to print variable indicia on both faces of the label. The label roll 22 preferably includes a plurality of linerless duplex labels 32 attached end-to-end. In the preferred embodiment, the label roll 22 includes a continuous web of single-ply thermal-transfer stock 36 (i.e., a label substrate) that presents the end-to-end linerless duplex labels 32, and the continuous web is wound in a roll onto a sleeve 34. However, it is within the ambit of the present invention where the continuous label web is alternatively provided. As will be discussed further, the labels 32 are detachable from the label roll 22.

The linerless duplex labels 32 are each preferably configured to receive packing and shipping information. Thus, while the labels 32 preferably serve as combination shipping and packing slip labels, the principles of the present invention are applicable where the labels 32 are printed to provide a business form with alternative printed indicia. Each label preferably comprises thermal-transfer stock 36 with a release coating 38 (see FIG. 4) and an exposed adhesive layer 40 (see FIGS. 5 and 6) being provided on opposite sides thereof. The thermal-transfer stock 36 preferably comprises a single-ply thermal-transfer stock, but other types of single-ply printer stock (such as direct-thermal stock, plain paper stock, etc.) could be used without departing from the scope of the present invention. Furthermore, the label roll 22 could have a continuous web of a thermal-transfer stock cooperatively formed by two or more plies. For instance, the stock could have two plies, with the release coating 38 and exposed adhesive layer 40 being applied to opposite exposed faces of the adhered plies. Furthermore, the stock could alternatively include a liner ply so that other plies may be removed therefrom.

Each label 32 includes opposite side edges 42 that define a substantially continuous width W therebetween and opposite end edges 44 that define a length L of the label (see FIG. 5). Preferably, the width W is in the range of about one (1) inch to about ten (10) inches and, more preferably, about five (5) inches to about eight (8) inches. The length L preferably is in the range of about 1 inch to about 14 inches and, more preferably, about 4 inches to about 10 inches. The illustrated stock 36 also presents opposite top and bottom faces 46,48 that are preferably printable by thermal-transfer printing methods. However, the principles of the present invention are equally applicable where the stock 36 is configured to be printed using another printing method, e.g., direct-thermal printing, laser printing, or ink jet printing.

The release coating 38 serves to permit multiple labels 32 to be removably overlaid with one another, as will be discussed further. The release coating 38 preferably comprises a silicone coating applied in a continuous layer on the top face 46 of the thermal-transfer stock 36. Preferably, the layer of release coating 38 extends continuously to cover the entire top face 46. However, the release coating 38 could be alternatively configured without departing from the scope of the present invention. For instance, the release coating 38 could include a material other than silicone for providing a release mechanism. It is also within the scope of the present invention where the release coating 38 does not completely cover the top face 46. For example, the release coating 38 could alternatively be print-applied within only a border region (as defined below). Furthermore, the print and apply station 30 could alternatively be provided with an adhesive device that applies adhesive to the web just prior to printing. In this configuration (and possibly others), the release coating 38 could be eliminated altogether.

Turning to FIGS. 5 and 6, the exposed adhesive layer 40 serves to adhere the label 32 to package P and is preferably applied in an endless border pattern along the bottom face 48 to present inner and outer adhesive margins 50,52. The illustrated adhesive layer 40 is preferably configured so that the outer adhesive margin 52 extends along the edges 42,44 of the stock 36, with only a small adhesive-free end strip 53 being immediately adjacent the outer adhesive margin 52. The continuous border of adhesive reduces the risk of inadvertent label removal during shipping. However, the principles of the present invention are also applicable where another part of the bottom face 48 (or even no part of the bottom face 48) extends outwardly from the outer adhesive margin 52. Also, it is within the ambit of the present invention where the adhesive layer 40 does not form an endless border pattern, but defines one or more adhesive free areas that extend continuously from at least one of the edges 42,44 to an adhesive-free central portion of the stock 36 (e.g., the adhesive layer could alternatively be printed in areas spaced around the perimeter of the label).

The illustrated adhesive layer 40 extends continuously inwardly from the outer adhesive margin 52 to present side areas 54 and end areas 56 of the endless adhesive border pattern, with the inner adhesive margin 50 extending endlessly along the areas 54,56. The inner adhesive margin 50 serves to define an adhesive-free region 58 of the stock 36 along the bottom face 48. The adhesive-free region 58 presents a width Wa and a length La (see FIG. 6). The margins 50,52 cooperatively define an endless border region 60 of the stock 36 that is substantially covered with adhesive along the bottom face 48. However, for some aspects of the present invention, adhesive could be applied to part of the region 58, e.g., to further adhere the label 32 to the package P.

Furthermore, the adhesive-free region 58 is configured to present a printable region 62 of the bottom face 48, with the adhesive layer 40 preferably surrounding the printable region 62 to securely conceal the printable region 62 when the label 32 is applied to package P. As will be discussed further, the printable region 62 defines the area in which variable printed indicia is printed within the adhesive-free region 58. However, it will be appreciated that the printable region 62 could include one or more longitudinally extending areas that are not printed. The printable region 62 presents a width Wp and a length Lp (see FIG. 6). The width Wp and length Lp of the printable region 62 are preferably less than, respectively, the width Wa and length La of the adhesive-free region 58.

The printable region 62 could also be defined as another area of the adhesive-free region 58. Yet further, the principles of the present invention are applicable where another section of the bottom face 48 is adhesive-free and also printable (e.g., a section spaced outwardly from the adhesive layer 40). It is also within the scope of the present invention where the printable region 62 extends up to a location immediately adjacent the inner adhesive margin 50. As will be discussed, the printable region 62 determines the location of the lower print head and where the lower print head prints along the label web.

For the illustrated label web, multiple printable regions 62 are spaced along the length of the web, with each adjacent pair of printable regions 62 being separated by a respective end area 56 of adhesive. However, for some aspects of the present invention, adhesive may not be provided between each adjacent pair of printable regions 62.

The illustrated adhesive layer 40 preferably comprises a permanent adhesive. As used herein, the term "permanent adhesive" refers to an adhesive that is operable to adhere the stock 36 to the package P or another substrate, with removal of at least part of the stock 36 from the package P resulting in physical damage to the stock 36 and/or the package P, with the damage being visibly evident to the naked eye. In this manner, the use of permanent adhesive serves to make the applied label 32 tamper-evident. However, according to some aspects of the present invention (see below), the adhesive layer 40 could alternatively be formed (in whole or in part) of a temporary adhesive, i.e., adhesive that permits label removal without visibly damaging the stock 36 or package P. Furthermore, another mechanism could be used to cause the label 32 to be tamper-evident.

The adhesive layer 40 also preferably comprises a pressure sensitive adhesive. However, the adhesive layer 40 could include an alternative adhesive, such as an activated adhesive (e.g., a heat-activated adhesive, water-activated adhesive, light-activated adhesive, or other type of activated adhesive).

The label 32 further preferably includes side perforations 64 and end perforations 66,68,70 that permit the label 32 to be separated into a removable central portion 72 and a surrounding border portion 74. In particular, the perforations 66,68,70 are preferably spaced inwardly from the inner adhesive margin 50. The perforations 66,68,70 cooperatively provide an endless line of weakness that defines the central portion 72 and the border portion 74, with the central portion 72 being entirely removable from the endless border portion 74. It is also within the ambit of the present invention where the perforations 66,68,70 are aligned with the inner adhesive margin 50 or positioned outwardly from the inner adhesive margin 50 (e.g., to permit limited adhesive engagement between the removable central portion 72 and the package P when the label 32 is applied to the package P). Yet further, the perforations 66,68,70 could alternatively be located within the printable region 62 or eliminated altogether (particularly if a temporary adhesive is used).

Perforation 68 extends along the central portion 72 between perforations 64 and is inwardly spaced from and adjacent to perforation 70. Perforations 64,68,70 cooperatively define a tear strip 76 of the central portion 72 that connects portions 72,74 of the stock 36 to each other. The illustrated tear strip 76 is removable to present an unsupported margin 78 of the central portion 72 adjacent an end of the label 32. The unsupported margin 78 permits a user to grab both faces 46,48 along the margin 78 and remove the central portion 72 from the endless border portion 74 by pulling the margin 78 in a direction toward the opposite end of the label 32. The illustrated tear strip 76 is preferably positioned at one end of the central portion 72, but could be alternatively positioned (e.g., along one side of the central portion 72) without departing from the scope of the present invention.

The tear strip 76 preferably terminates at the endless border portion 74 so that the tear strip 76 is spaced from the edges 42,44 of the stock 36. However, for some aspects of the present invention, one or both ends of the tear strip 76 could be alternatively positioned along the label. For instance, one or both tear strip ends could extend to the respective side edge 42 (e.g., to provide convenient access to the tear strip end). While the illustrated labels 32 each preferably include the tear strip 76, the labels 32 could have an alternative access feature, such as a pick-point opening, to provide access to the central portion 72.

Turning to FIGS. 4 and 5, the printed label 32 includes top and bottom indicia 80,82 on respective top and bottom faces 46,48. As will be shown, the indicia 80,82 may include variable indicia (i.e., indicia that can vary with each label and associated package P) and non-variable indicia (i.e., indicia that generally does not change from label to label or from order to order). Furthermore, some of the indicia may be preprinted (e.g., before the single-ply substrate is wound into roll 22).

The top indicia 80 presented on top face 46 preferably includes sender address indicia 84, recipient address indicia 86, package size and package number indicia 88, bar code indicia 90 operable to provide a unique identifier associated with the package P that can be electronically scanned, package tracking indicia 92 operable to identify the carrier and a unique carrier tracking number associated with the package, and tear strip indicia 94. The top indicia 80 illustrated on the top face 46 is all printed on the central portion 72, but the principles of the present invention are applicable where at least some indicia is printed on the endless border portion 74. As will be discussed further, the top indicia 80 is generally exposed and visible when the label 32 is applied to the package P.

The bottom indicia 82 presented on the bottom face 48 includes sender address indicia 96; recipient address indicia 98; purchase order indicia 100 that includes a purchase order number, control number, customer account number, and order and ship dates of the purchase; package contents and billing indicia 102 that provides an itemized list of the package contents, the cost of each item listed alongside the corresponding item, the subtotal, shipping and handling cost, tax, and total cost; credit card indicia 104 including part of the customer's credit card number; order information indicia 106; tear strip indicia 108; and timing mark indicia 110. The bottom indicia 82 illustrated on the bottom face 48 includes information confidential to the sender and recipient. Therefore, the bottom indicia 82 is printed on the central portion 72 and is generally hidden from view when the label 32 is applied to the package P. However, the principles of the present invention are applicable where at least some indicia printed on the bottom face 48 is printed on another portion of the bottom face 48 (e.g., where part of the bottom face 48 extends outside of the adhesive border and is configured to receive printed indicia). Thus, some of the indicia on the bottom face 48 could be viewable without removing the applied label 32.

The indicia 84,94,96,108 generally comprise non-variable indicia. Indicia 86,88,90,92,98,100,102,104 generally includes variable indicia. Thus, both faces of the label 32 include variable indicia, and the variable indicia on both faces of the label 32 can be associated with a particular order for the contents of package P. As will be discussed further, in printing indicia on both label faces, the indicia on the top face 46 can be matched with the indicia on the bottom face 48 to provide all of the indicia associated with the corresponding order. This facilitates proper shipment of the correct items to the correct recipient.

The variable portions of top and bottom indicia 80,82 are preferably printed by thermal-transfer printing, but could alternatively be printed by other printing methods, such as direct-thermal, laser, ink jet printing, or a combination of printing methods. It is also within the scope of the present invention where the top indicia 80 is printed by one printing method and the bottom indicia 82 is printed by a different printing method. For instance, one of the indicia 80,82 could be printed by direct-thermal printing and the other one of the indicia 80,82 could be printed by thermal-transfer printing. Also, one of the indicia 80,82 could be printed by ink jet printing and the other one of the indicia 80,82 could be printed by thermal-transfer printing.

Preferably, the duplex printer 24 is configured to print only the variable indicia on the faces 46,48, with the stock being preprinted with the nonvariable indicia. However, the principles of the present invention are equally applicable to the printer 24 serving to print both the variable and nonvariable indicia. It is also possible for the label 32 to be provided with only variable or nonvariable indicia.

The illustrated label 32 is configured so that confidential indicia, such as the package contents indicia 102 and credit card indicia 104, is only located on the bottom face 48 along the central portion 72 and is thereby hidden when the label 32 is applied to package P. Thus, the label 32 must be at least partly removed from the package P to access the confidential indicia. Due to this tamper-evident label construction, the label 32, the package P, or both are visibly damaged when the label 32 is at least partly removed from the package P. Although the bottom face 48 preferably has confidential indicia in the form of package contents indicia 102, credit card indicia 104, etc., other types of confidential indicia could be applied. For instance, the bottom face 48 could contain a confidential message, such as that associated with shipping of the package P as a gift. For some aspects of the present invention, the bottom face 48 may not contain any package contents indicia relating to the contents of the package P.

The top and bottom indicia 80,82 comprise the only information associated with the package P and the associated order that is carried by the illustrated label 32 for visual and electronic identification (by the sender, distributor, or recipient). But it is also within the ambit of the present invention where the label 32 includes other package or order identification features, e.g., other types of machine-readable features. For instance, the label 32 could include an RFID tag attached to the stock 36, with the tag carrying information in machine readable form.

The labels 32 are attached end-to-end to form the continuous web, and the web is wound to form the roll 22. In particular, the labels 32 are arranged so that the top and bottom faces 46,48 each extend continuously along the length of the web. Thus, the web is mounted to the sleeve 34 with the adhesive bottom face 48 engaging the sleeve 34. As the web is wound to form the roll 22, the adhesive bottom face 48 of each label 32 engages and overlies the top face 46 of the underlying label(s) 32 on the roll 22. The release coating 38 on the top face 46 permits removable adhesion between adjacent overlaid labels 32 on the roll 22 so that the labels 32 are removable from each other without becoming damaged. The end-most label 32, i.e., the label at an exposed end 112 of the web (see FIG. 1), can be removed from overlaid engagement with the label(s) 32 therebelow and can be separated from the web using the timing marks as described below.

Figure 2:
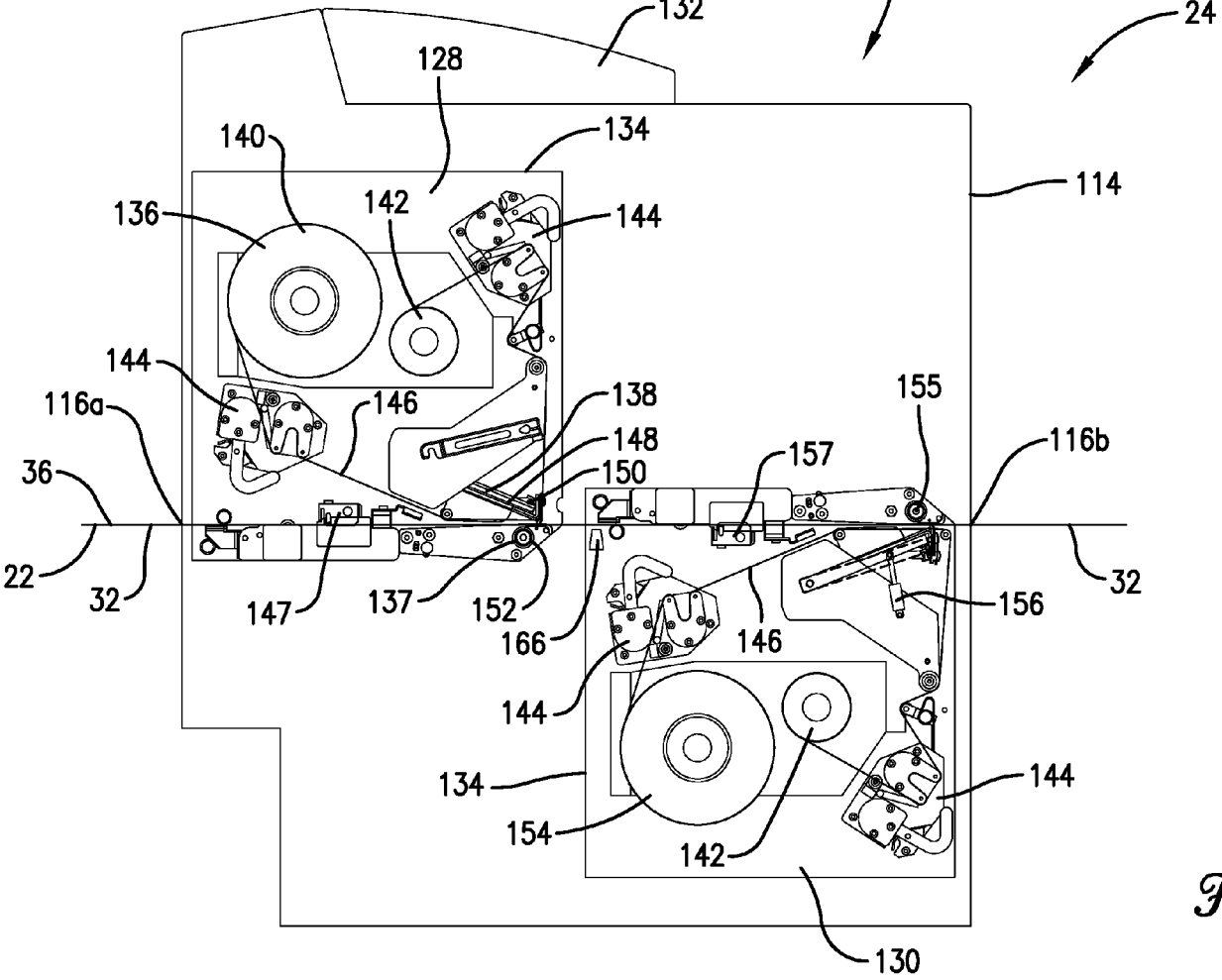
FIG. 2 is a schematic view of the duplex printer and label web shown in FIG. 1, showing upper and lower print engines and a controller of the duplex printer, with each print engine including a frame to support the print engine within the printer housing, a ribbon assembly, and a print head assembly.
Figure 3:
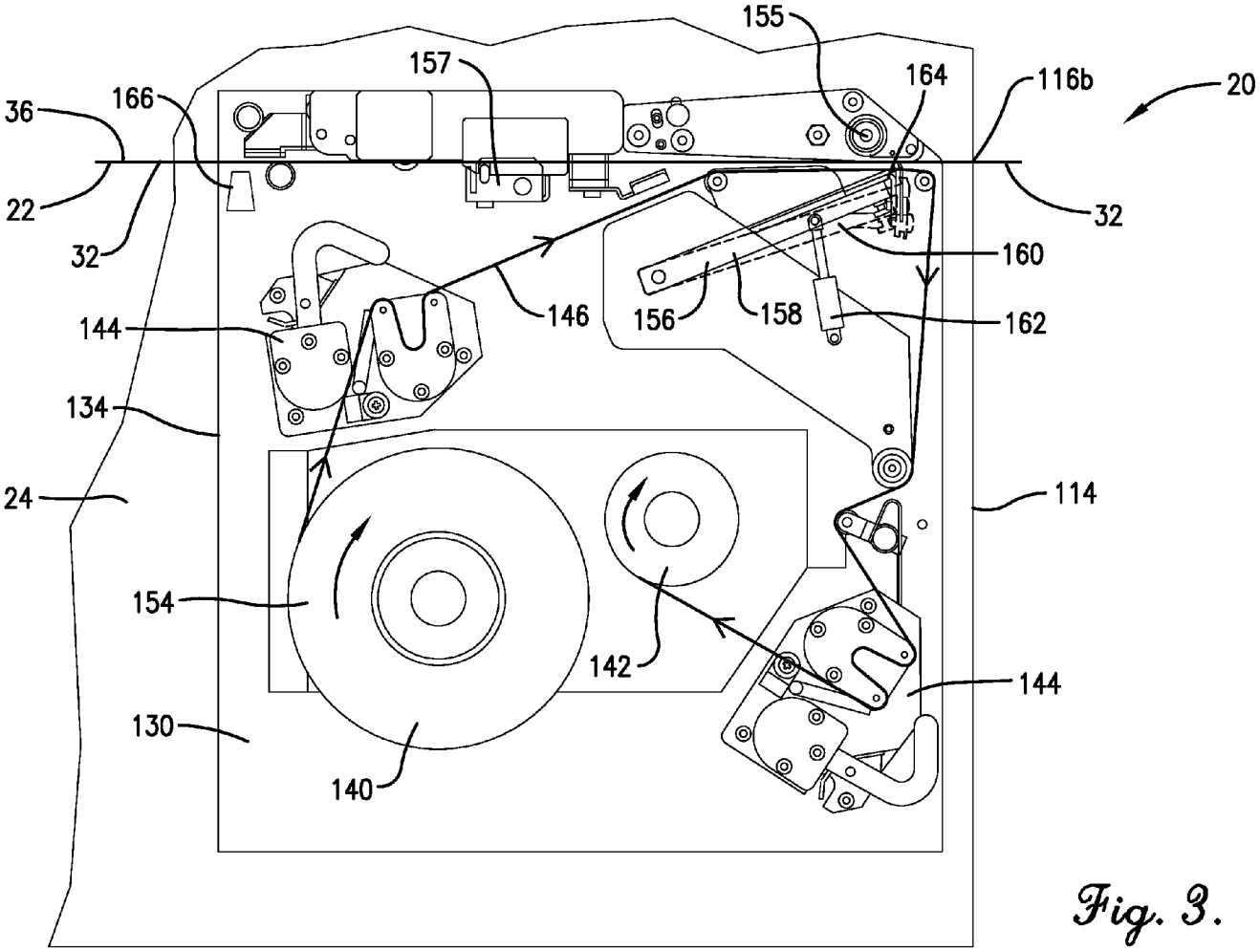
FIG. 3 is a fragmentary schematic view of the duplex printer and label web shown in FIGS. 1 and 2, showing the label web being advanced through the lower print engine, with the print head assembly including a pivotal support, a print head mounted on the support, and an actuator that interconnects the support and frame and pivots the support and print head between printing and skipping positions.

Turning to FIGS. 1-3, the duplex printer 24 is configured to print the label 32 in a single printing pass. The duplex printer 24 includes a housing 114 that presents a form inlet 116*a* that receives the incoming web and a form outlet 116*b* through which the printed web is discharged from the printer 24. As will be discussed, the duplex printer 24 includes upper and lower print heads positioned within the printer housing 114 for printing indicia on corresponding top and bottom faces 46,48. The label roll 22 is rotatably supported by a frame (not shown) adjacent the form inlet 116*a* of the duplex printer 24.

The cutter 26 comprises a conventional cutting mechanism for cutting the end-most label 32 from the rest of the continuous web. The cutter 26 includes a housing 118 and a cutting blade (not shown). The illustrated cutter 26 also includes a sensor 120 that identifies when the timing mark indicia 110 reaches the blade, with the cutter 26 then shifting the blade to make a transverse cut along the timing mark indicia 110 to separate the end-most label 32 from the web. However, it is also within the scope of the present invention where the cutter 26 is operable to make a cut at each label end without sensing the indicia 110. For instance, the station 30 could be programmed to feed the continuous web a predetermined length and then cut the label 32 to the predetermined length, with the station 30 being operable to cut multiple labels 32 to the same predetermined length. The cutter 26 is operably coupled to a controller of the printer 24 so as to be electronically controlled by the printer 24. However, the cutter 26 could be operated by a separate electronic controller. Also, the cutter 26 could be mechanically controlled, e.g., by a mechanical gear arrangement powered by the printer 24.

The illustrated timing mark indicia 110 is preferred to cue activation of the cutter 26. However, an alternative cue mark could be provided to activate the cutter, such as a notch in the label web.

The illustrated cutter 26 is mounted externally to the duplex printer 24, but could be an integral component of the printer 24 without departing from the scope of the present invention. Furthermore, cutting of the end-most label 32 could occur before or after printing of either face 46,48. While the end-most label 32 is preferably separated from the web by the cutter 26, it is within the scope of the present invention where the end-most label 32 is separated by another mechanism. For instance, the web could include a line of weakness extending along each indicia 110 and the labels 32 could be separated by a mechanism that bursts or tears the web along the line of weakness. Alternatively, the end-most label 32 could be manually separated from the label web.

The label applicator 28 is configured to apply label 32 to package P when the package P is in a labeling position (see FIG. 1). The applicator 28 includes an applicator arm 122 and an applicator pad 124 attached to the end of the arm 122. The pad 124 preferably comprises a unitary base that presents a substantially flat lower pad surface (not shown) suitable to apply a label with pressure sensitive adhesive. However, it is within the ambit of the present invention where the pad 124 also includes a heating element attached to the base so that the pad 124 is capable of also activating the adhesive. That is, the heated applicator pad could both heat the label to activate the heat-activated adhesive and also apply the label to the package P (before, during, and/or after the adhesive is activated).

Preferably, the label applicator 28 further includes a vacuum source (not shown) that is operably coupled to the pad 124. The vacuum source is operable to produce a vacuum condition adjacent the lower pad surface of the pad 124 so that the vacuum pressure (i.e., pressure less than ambient pressure) provided by the vacuum source is sufficient to hold the label 32 against the lower pad surface. Also, the vacuum source is operably coupled to a controller (not shown) of the label applicator 28 so that the controller can operate the vacuum source to selectively apply or remove the vacuum condition. Thus, the label applicator 28 is preferably configured so that one of the labels 32 can be held in engagement with the lower pad surface when the vacuum condition is applied.

The arm 122 is slidably mounted to a housing 126 so that the arm 122 can reciprocate relative to the housing 126. The label applicator 28 also preferably includes a motor (not shown), such as a pneumatic or electric servo motor, drivingly attached to the arm 122 and operable to shift the arm 122 relative to the housing 126. The controller of the label applicator 28 is operably coupled to the motor so that the controller can operate the motor to selectively move the arm 122 and pad 124 between a retracted position (see FIG. 1) and an extended position (not shown). In the retracted position, the pad 124 is preferably spaced from the package P (e.g., to allow shifting of the package P into or out of the labeling position). In the extended position, the pad 124 is positioned adjacent to or in direct contact with package P, when the package P is in the labeling position, to apply the label 32 to the package P. It will be appreciated that the applicator 28 can be configured to accommodate different package sizes, such as variable-height cartons.

The illustrated label applicator 28 is operable to locate the pad 124 in the retracted position to receive and hold a label 32 for subsequent application to the package P. In the retracted position, the vacuum condition is applied so that the endmost label 32 separated by the cutter 26 is drawn into engagement with the lower pad surface and held in place. Furthermore, the vacuum condition is preferably maintained as the pad 124 and label 32 are shifted from the retracted position to the extended position.

The label applicator 28 is operable to shift the arm 122 and pad 124 into the extended position to apply the held label 32 to the package P. The label applicator 28 can then return the arm 122 and pad 124 from the extended position to the retracted position so that another label 32 can be applied to another package.

The illustrated printer 24 is particularly configured to print the linerless label web with exposed adhesive. As will be discussed, the label web is advanced through the printer 24 with the lower face of the label web facing downwardly, with the adhesive being positioned on the bottom of the label stock. However, it will be appreciated that the printer 24 could be configured to print the label web in an inverted orientation so that the lower face of the label web faces upwardly, with the adhesive being positioned on the top of the label stock.

The duplex printer 24 preferably includes the housing 114, upper and lower print engines 128,130, and a controller 132. However, as will be discussed, the printer 24 could have an alternative dual print head construction. The upper print engine 128 preferably prints the adhesive-free face of the label web (i.e., the top face 46). Preferably, the upper print engine 128 provides thermal-transfer printing and includes a frame 134, ribbon assembly 136, platen roller 137, and print head assembly 138. The frame 134 serves to support the ribbon and print head assemblies 136,138 within the housing 114.

The ribbon assembly 136 is used for thermal-transfer printing of a substrate and includes supply and take-up rolls 140, 142, dancer arm assemblies 144, and thermal ribbon 146. The ribbon assembly 136 generally advances ribbon 146 to the corresponding print head as the label supply 22 is advanced. However, it is within the scope of the present invention where the controller 132 is used to stop advancement of the ribbon 146 during advancement of the label supply 22. For instance, ribbon advancement could be temporarily halted as the an area of the label web that is not being printed passes the print head of the print head assembly 138.

The platen roller 137 serves to drive the label web through the print engine 128 and is powered by a motor (not shown), which is operably coupled to the controller 132. The print engine 128 also includes other label guide mechanisms, such as a pinch roller assembly 147 that includes a pair of pinch rollers on opposite sides of the label web and operates to tension and guide the label web. The label-engaging rollers of the print engine 128, including the platen roller 137 and pinch rollers, direct the linerless label web along the path (as shown in FIG. 2) through the printer 24 and each preferably comprise so-called "plasma" or Teflon rollers. The material and configuration of the printer rollers is important, particularly for the rollers that engage the adhesive face of the label web, i.e., the bottom face 48.

The print head assembly 138 preferably includes a pivotal support 148 and a print head 150 removably attached to the support 148. In the usual manner, the print head 150 includes a printer interface 152 with heating elements (not shown) along which the print head 150 prints on the label web (see FIGS. 2 and 4). The support 148 is pivotally mounted to the frame 134 and is shiftable between a printing position, where the print head 150 is in printing engagement with the label supply 22, and a retracted position (not shown), where the print head 150 is pivoted away from the label supply 22. In the retracted position, the print head 150 is preferably pivoted away from the label supply 22 at an angle of about thirty (30)

degrees. Positioning the print head 150 in the retracted position (or in a location between the printing and retracted positions) permits various maintenance steps to be performed, such as cleaning and removal of the print head 150.

In the illustrated embodiment, the printer interface 152 presents an interface width W1 (see FIG. 4). The printer interface 152 is preferably dimensioned to extend across most of the width of the central portion 72 when the central portion 72 is adjacent the printer interface 152. However, the printer interface 152 could present an alternative width (e.g., where the printer interface 152 extends laterally beyond one or both of the perforations 64).

While the upper print engine 128 preferably comprises a thermal-transfer print head with ribbon, the print engine could have an alternative print head. For instance, the upper print engine 128 could include a direct-thermal, laser, or ink jet print mechanism, or a combination thereof. Also, the illustrated print head assembly 138 is preferably fixed during operation. However, the print head assembly 138 could have a shiftable print head similar to the lower print engine 130.

The lower print engine 130 also preferably provides thermal-transfer printing and includes a frame 134, ribbon assembly 154, platen roller 155, and a shiftable print head assembly 156. The lower print engine 130 preferably prints the label web face that carries adhesive (i.e., the bottom face 48).

The ribbon assembly 154 of lower print engine 130 also is used for thermal-transfer printing and includes supply and take-up rolls 140,142, dancer arm assemblies 144, and thermal ribbon 146. The ribbon assembly 154 generally advances ribbon to the corresponding print head as the label supply 22 is advanced. However, it is within the scope of the present invention where the controller 132 is used to stop advancement of the ribbon 154 during advancement of the label supply 22. For instance, ribbon advancement could be temporarily halted as the an area of the label web that is not being printed passes the print head of the print head assembly 156.

The platen roller 155 serves to drive the label web through the print engine 130 and is powered by a motor (not shown), which is operably coupled to the controller 132. The print engine 130 also includes other label guide mechanisms, such as a pinch roller assembly 157 that includes a pair of pinch rollers on opposite sides of the label web and operates to tension and guide the label web. The label-engaging rollers of the print engine 128, including the platen roller 137 and pinch rollers, direct the linerless label web along the path (as shown in FIG. 2) through the printer 24 and each preferably comprise so-called "plasma" or Teflon rollers. Again, the material and configuration of the printer rollers is important, particularly for the rollers that engage the adhesive face of the label web, i.e., the bottom face 48.

The print head assembly 156 preferably includes a pivotal support 158, a print head 160 removably attached to the support 158, and an actuator 162. In the usual manner, the print head 160 includes a printer interface 164 with heating elements (not shown) along which the print head 160 prints on the label web (see FIGS. 2 and 6). The support 158 is pivotally mounted to the frame 134 and is shiftable between a printing position, where the print head 160 is in printing engagement with the label supply 22, and a retracted position (not shown), where the print head 160 is pivoted away from the label supply 22 at an angle of about thirty (30) degrees. Again, locating the print head 160 in the retracted position (or in a location between the printing and retracted positions) permits various maintenance steps to be performed, such as cleaning and removal of the print head 150.

In the illustrated embodiment, the printer interface 164 presents an interface width W2 (see FIG. 4). The printer interface 164 is preferably dimensioned to extend across substantially the entire width Wp of the printable region 62. Furthermore, the interface width W2 is preferably set to be the same as the desired width Wp. However, the printer interface 164 could present an alternative width. For instance, the interface width W2 could be spaced within the width Wp of the printable region 62. In any event, the interface width W2 is preferably spaced from the side areas 54 of adhesive so as to avoid contact with the adhesive.

While the lower print engine 130 preferably comprises a thermal-transfer print head with ribbon, the print engine could have an alternative print head. For instance, the lower print engine 130 could include a direct-thermal, laser, or ink jet print mechanism, or a combination thereof. The print engines 128,130 both include thermal-transfer print heads. However, the print engines 128,130 could have different types of print heads. For instance, the print engine 128 could have a direct-thermal print head, and the print engine 130 could have a thermal-transfer print head.

Turning to FIG. 4, the actuator 162 is preferably an electric motor that interconnects the support 158 and the frame 134 to control pivoting of the support 158 and the print head 160 between the printing position (shown in solid lines) and a skipping position (shown in broken lines). However, the actuator 162 could comprise an alternative motor, such as a pneumatic motor. The skipping position is preferably between the printing and retracted positions and, more preferably, is closer to the printing position than the retracted position.

Turning to FIG. 6, the actuator 162 preferably operates to shift the print head 160 to the skipping position when a trailing end 168*a* of the printable region 62 reaches the printer interface 164. By so shifting, the printer interface 164 is spaced from the label web as the end areas 56 of adhesive travel across the printer interface 164. Consequently, the printer interface 164 avoids contact with adhesive along the end areas 56.

The actuator 162 also preferably operates to shift the print head 160 to the printing position when a leading end 168*b* of the printable region 62 reaches the printer interface 164. By so shifting, the printer interface 164 does not engage the label web until the end areas 56 adjacent the printer interface 164 have traveled across the printer interface. Again, this allows the printer interface 164 to avoid contact with the adhesive.

The print head assembly 156 also preferably includes an optical sensor 166 (see FIG. 4). The sensor 166 is positioned adjacent to the label web and faces the bottom face 48. The sensor 166 is also positioned to sense the timing mark indicia 110 as the label web is advanced through the printer 24.

The actuator 162 and sensor 166 are preferably operably coupled to the controller 132. Thus, when the sensor 166 senses the timing mark indicia 110, the controller 132 automatically operates the print head assembly 156 to shift the print head 160 into the skipping position and then into the printing position so that the printer interface 164 avoids contact with adhesive of the end areas 56. At the same time, because the controller 132 is operably coupled to the platen roller 155 and the associated motor, the controller 132 is capable of driving the platen roller 155 and the label web when the exposed adhesive area is adjacent the shiftable print head 160. In particular, the controller 132 operates the platen roller 155 to continue feeding the label web through the print engine 130 as the print head 160 is shifted between the skipping and printing positions.

The illustrated timing mark indicia 110 is preferred to cue activation of the actuator 162. However, an alternative cue mark could be provided to activate the actuator 162, such as a notch in the label web. If desired, separate timing marks adjacent opposite ends of the printable region may be provided to activate shifting of the print head.

Turning to FIGS. 1-6, as the web passes through the duplex printer 24, the top and bottom faces 46,48 of each label 32 are preferably printed by the duplex printer 24 sequentially during the single printing pass. In particular, the printer 24 prints the bottom face 48 after printing the top face 46. However, it is within the scope of the present invention where the top and bottom faces 46,48 are printed simultaneously during the single printing pass (with the heads being aligned along the web path on opposite sides of the label web). The single printing pass may likely involve minimal back-and-forth movement of the label 32 along the longitudinal direction as the label 32 is being printed (e.g., to permit printing of the label 32 by multiple print heads), but it is also within the scope of the present invention where the label 32 is fed continuously through the printer 24 at a constant speed during printing of the label 32.

Again, the illustrated duplex printer 24 is preferably a thermal-transfer printer, but the principles of the present invention are equally applicable where the printer 24 includes another type of print head, such as a direct-thermal head, a laser head, or an ink jet head, or a combination of print head types. For instance, the printer 24 could have one type of print head that serves as the upper print head to print the top face 46 and another type of print head spaced below the upper print head and serving as the lower print head to print the bottom face 48. Furthermore, multiple types of print heads could be used to print either the top or bottom faces 46,48. While all of the illustrated variable indicia on label 32 is printed by the printer 24 using thermal-transfer printing, it is also within the scope of the present invention where at least some of the indicia on label 32 is printed using direct-thermal, laser, or ink jet printing. Furthermore, some of the indicia, particularly the non-variable indicia, could be pre-printed on the continuous web (i.e., prior to printing by the duplex printer 24).

As discussed above, the printer system 20 is operable to print the label 32 on both faces 46,48 with variable indicia, such as recipient address indicia 86 and package contents and billing indicia 102. All of the variable indicia printed on label 32 is associated with the particular package P, the contents of the package P, and the recipient of the package. Therefore, the system 20 associates (or matches) all of the variable indicia for each label 32 prior to printing of the label 32. For example, the system 20 could include a computer (not shown) for compiling and associating the information for each label 32. The system 20 also provides printing instructions to the printer 24 so that the associated (or matched) indicia is printed on the same label 32. It is also within the scope of the present invention where only some portions of the variable indicia printed on the label 32 are associated with each other. Also, while the illustrated variable indicia is associated with the corresponding package P, some variable indicia could be associated by another type of association (e.g., the recipient address indicia 98 and the account number of the purchase order indicia 100 can be associated with the name of a recipient).

The illustrated system 20 is preferably configured to operate as part of the print and apply station 30, which is electronically operated and can apply printed labels to a plurality of packages P. But the principles of the present invention are applicable where some steps of the label print and application process are performed manually. Because the system 20 is configured to print variable indicia on both label faces, the system 20 can also apply labels to a plurality of packages P, where each package P has at least some indicia that is different from the other packages P. For instance, the system 20 is operable to print and apply labels to multiple packages P, with each package having different contents and each label 26 having different package contents indicia. Similarly, the recipient address indicia is likely different between each package.

The central portion 72 of the applied label 32 is removable from the endless border portion 74 by initially separating the tear strip 76 from the portion 74. In particular, one end of the tear strip 76 is grabbed and drawn by the user toward the other end of the tear strip 76. The tear strip 76 can be either partly or completely removed, and this separation of the tear strip 76 leaves the label 32 in an unsecured configuration where the bottom indicia 82 is no longer securely concealed. Furthermore, the unsupported margin 78 of the central portion 72 is exposed to permit the user to grab the margin 78 on both faces 46,48. The margin 78 can then be drawn away from the endless border portion 74 to separate the central portion 72 from the endless border portion 74 to a greater degree and further enable viewing of bottom indicia 82. The central portion 72 can also be completely detached from the endless border portion 74. In this instance, the detached central portion 72 serves as a packing slip that can be processed by the package recipient, e.g., to confirm that the contents ordered were actually shipped in the package, and can be saved as a record of the transaction.

In operation, the station 30 is operable to efficiently apply packing and shipping labels to multiple packages while minimizing label waste and incidences of equipment failure. The label roll 22 dispenses the continuous web of labels 32 into the printer 24 by unrolling a label 32 from overlaid adhesion with another label(s) 32. That is, an outer label 32 is unrolled from an adjacent inner label(s) 32 by separating the adhesive face of the outer label 32 from the adhesive-free face of the inner label(s) 32. Again, the illustrated labels 32 include some pre-printed indicia on the continuous web prior to printing with printer 24 if desired. As labels 32 pass from the form inlet to the form outlet 116 in a single printing pass, indicia 80,82 is printed on top and bottom faces 46,48. The printed labels 32 then pass out of the form outlet 116 and into the cutter 126 so that the end-most label 32 is separated from the rest of the continuous web. The separated label 32 is then positioned adjacent the package P, and the label applicator 28 adheres the label 32 onto the package P in a flat and unfolded condition. The bottom face 48 of the adhered label 32 is positioned in adhesive engagement with the package P, and the indicia 82 printed on the bottom face 48 is thereby hidden by the adhered label 32 and package P in a secured label configuration. In addition, the top face 46 is exposed to permit viewing and electronic scanning of indicia 80 printed thereon. The station 30 is configured to print and apply a plurality of labels 32 to corresponding packages P, with the indicia on each side of the label 32 being matched with each other and with the package P. The bottom indicia 82 printed along the central portion 72 is exposed for viewing by first removing the tear strip 76 from the portions 72,74 to present the unsupported margin 78. The recipient can then grasp the exposed margin 78 to remove the central portion 72 from the endless border portion 74, with the central portion 72 thereby serving as a packing slip (or packing list). Without departing from the scope of the present invention, the illustrated central portion 72 could alternatively be used and/or referred to as a carton contents list or an invoice.

Again, while the illustrated station 30 is preferably used to print and apply combination shipping and packing slip labels, the principles of the present invention are applicable where the station 30 is used to print an alternative business form. For instance, the station 30 could be used to print a label associated with shipping the package P as a gift.

Turning to FIG. 7, an alternative print and apply station 200 is constructed in accordance with a second embodiment of the present invention. For the sake of brevity, the remaining description will focus primarily on the differences of this alternative embodiment from the embodiment described above. The station 200 includes an alternative duplex printer 202, a label cutter 204, and a label applicator 206. A label supply 208 is used with the station 200 and preferably includes a plurality of linerless duplex labels attached end-to-end as part of a continuous label web.

The duplex printer 202 includes a housing 210 and upper and lower print engines 212,214. The duplex printer 202 also includes upper drive rollers 216 and lower rollers 218. The rollers 218 each preferably comprise so-called "plasma" rollers or Teflon rollers. It will be appreciated that the drive rollers 216 could be below the label web instead of above the label web. The illustrated print engine 212 includes a print head assembly 220. Print engine 214 preferably includes a shiftable print head assembly 222 similar to print head assembly 156. The print head assemblies 220,222 present corresponding printer interfaces 224,226, with the interface 226 preferably being longitudinally offset from the interface 224. Relative to the direction of travel of the label web, the interface 226 is preferably positioned ahead of the interface 224. The interfaces 224,226 preferably define a longitudinal offset dimension therebetween that ranges from about zero (0) inches to about four (4) inches.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A duplex printer system comprising:

a double-sided label web operable to be printed on opposite first and second sides thereof, said first side of the label web presenting longitudinally spaced apart printable regions devoid of adhesive, said first side of the label web including exposed adhesive located at least in part between printable regions, said label web presenting longitudinally extending sides between which the label width is defined, each of said printable regions being spaced from a first one of the label sides to define a corresponding first side margin, said label web including exposed adhesive applied to a first adhesive side area located within the first side margin; and a duplex printer operable to print both sides of the label web as the label web is advanced longitudinally through the printer, said duplex printer including— a printer frame that presents a web path along which the label web passes longitudinally through the printer in a feed direction, and first and second print heads supported relative to the printer frame and arranged to print respective sides of the label web as the label web makes a single pass along the web path, said first print head being shiftably mounted relative to the printer frame for movement into and out of a printing position, in which the first print head is operable to print within a respective one of the printable regions, said first print head being selectively shifted out of the printing position so as to avoid contact with the exposed adhesive during label web advancement, said first print head including a printer interface positioned in printing engagement with the label web when the first print head is shifted to the printing position, said printer interface being spaced from the first adhesive side area and thereby prevented from engaging the exposed adhesive applied thereto when the first print head is shifted to the printing position.

2. The duplex printer system as claimed in claim 1, said printable regions being narrower than the width of the label web.

3. The duplex printer system as claimed in claim 2, said printer interface including heating elements for thermally printing the label web.

4. The duplex printer system as claimed in claim 3, said first print head comprising a thermal-transfer print head.

5. The duplex printer system as claimed in claim 2, said second print head including a second printer interface positioned in printing engagement with the label web, said printer interfaces being spaced from each other along the feed path.

6. The duplex printer system as claimed in claim 5, said first and second print heads each comprising a thermal-transfer print head.

7. The duplex printer system as claimed in claim 1, each of said printable regions being spaced from a second one of the label sides to define a corresponding second side margin, said exposed adhesive including a second adhesive side area located within the second side margin, said printer interface being spaced from the second adhesive side area when the first print head is shifted to the printing position, such that the printer interface is narrower than the label web and spaced between the label sides when the first print head is shifted to the printing position.

8. The duplex printer system as claimed in claim 7, each of said printable regions presenting longitudinally spaced apart ends, said exposed adhesive including adhesive end areas located adjacent the ends of each printable region.

9. The duplex printer system as claimed in claim 8, said adhesive side and end areas intersecting so as to define an adhesive boundary extending at least substantially continuously around each of the printable regions.

10. The duplex printer system as claimed in claim 9, said label web defining a series of individual labels arranged end-to-end along the length of the label web, each of said labels including a corresponding one of the printable regions and a corresponding one of the adhesive boundaries, each of said labels including a separable central portion in which the corresponding one of the printable regions is located.

11. The duplex printer system as claimed in claim 10, each of said labels including a line of weakness defining the central portion.

12. The duplex printer system as claimed in claim 11,
said printable region being spaced inside the line of weakness.

13. The duplex printer system as claimed in claim 10,
each of said labels being provided with a timing mark adjacent an end of the corresponding one of the printable regions.

14. The duplex printer system as claimed in claim 1,
said label web being a single ply substrate.

15. The duplex printer system as claimed in claim 1,
said duplex printer including an actuator coupled to the first print head to effect shifting thereof,
said duplex printer including a controller operable to selectively control the actuator to shift the first print head into and out of the printing position.

16. The duplex printer system as claimed in claim 15,
said label web including timing markers associated with the printable regions,
said duplex printer including a sensor operable to sense each timing marker during label web advancement,
said controller being operably coupled to the sensor to control the actuator in response to sensing of each timing marker.

17. The duplex printer system as claimed in claim 16,
each of said timing markers being a timing mark printed on the label web,
said sensor comprising an optical sensor.

18. The duplex printer system as claimed in claim 16,
said label web defining a series of individual labels arranged end-to-end along the length of the label web,
each of said labels including a corresponding one of the printable regions and a corresponding one of the timing markers.

19. The duplex printer system as claimed in claim 1,
only said first print head being shiftable during label web advancement, such that the second print head is fixed relative to the printer frame during label web advancement.

* * * * *